US005384913A

United States Patent [19]

Hendry

[11] Patent Number: 5,384,913

[45] Date of Patent: Jan. 31, 1995

[54] BODY PART IMPACT GUARD

[75] Inventor: James M. Hendry, Epsom, United Kingdom

[73] Assignee: Santillo Limited, United Kingdom

[21] Appl. No.: 853,732

[22] PCT Filed: Nov. 28, 1990

[86] PCT No.: PCT/GB90/01852

§ 371 Date: Jul. 27, 1992

§ 102(e) Date: Jul. 27, 1992

[87] PCT Pub. No.: WO91/08028

PCT Pub. Date: Jun. 13, 1991

[30] Foreign Application Priority Data

Nov. 28, 1989 [GB] United Kingdom ..... 8926862

[51] Int. Cl.[6] ..... A41D 13/00

[52] U.S. Cl. ..... 2/2; 2/22; 2/267; 602/5; 602/6; 602/23; 602/26

[58] Field of Search ..... 2/2, 2.5, 23, 22, 24, 2/16, 267, 247, 249, 250, 255; 602/5, 6, 23, 26

[56] References Cited

U.S. PATENT DOCUMENTS

| | | | |
|---|---|---|---|
| 3,465,364 | 9/1969 | Edelson | 2/22 |
| 3,670,339 | 6/1972 | Cooper et al. | 2/22 |
| 3,735,419 | 5/1973 | Byrd | 2/22 |
| 3,787,892 | 1/1974 | Quinn | 2/22 |
| 4,320,748 | 3/1982 | Racette et al. | 602/23 |
| 4,512,037 | 4/1985 | Vacanti | 2/2 |
| 4,756,026 | 7/1988 | Pierce, Jr. | 2/22 |
| 5,054,127 | 10/1991 | Zevchak | 2/247 |
| 5,105,473 | 4/1992 | Valtakari | 2/2 |
| 5,134,726 | 8/1992 | Ross | 2/2 |

FOREIGN PATENT DOCUMENTS

| | | | |
|---|---|---|---|
| 9010395 | 9/1990 | WIPO | 2/22 |

*Primary Examiner*—Clifford D. Crowder
*Assistant Examiner*—Gloria Hale
*Attorney, Agent, or Firm*—Barnes & Thornburg

[57] ABSTRACT

A body part protective guard is configured to overlie a body part to be protected. The guard includes an outer layer made of a force resistant, resiliently deformable material and having a backing layer made from an impact absorbing material coupled thereto for padding the outer layer. The outer layer includes a central strip portion, first and second integrally formed step portions located on opposite sides of the central strip portion, a first side portion formed integrally with the first step portion, and a second side portion formed integrally with the second step portion. The first and second step portions are each configured to provide a resilient flexure coupling between the central strip portion and the first and second side portions, respectively, to transfer an impact force occurring on the central strip portion to the first and second side portions, thereby reducing the magnitude of the impact force transferred to a portion of the backing layer adjacent the central strip portion.

5 Claims, 10 Drawing Sheets

BODY PART IMPACT GUARD

BACKGROUND OF THE INVENTION

This invention relates to methods of and arrangements for providing protection to parts of the human body against the full force arising from impacts, blows or the like.

In particular, but not exclusively, the present invention is concerned with the protection of the limbs of sports persons against the full impact force arising from a blow from, for example, a boot as is a likely possibility in respect of sports, for example, involving the kicking of a ball such as a football; a bat or the like in the case of sports involving the use of a ball striking implement i.e., hockey stick; sports involving the use of a relatively hard form of ball such as, for example, a cricket ball etc.

THE PRIOR ART

It is well known that a vital and highly important part of the kit (i.e., the equipment required by sports persons to practice and/or play their sport) of sports persons in the case of sports of the kind above mentioned are guards dedicated for a particular protective purpose.

In the case of football it has become a standard practice to provide a guard or shield for protecting the shins of a player against the full impact of forces likely to arise from being struck by a player's boot.

It will be understood that frequently at the time of such impact the two persons involved are not only moving at speeds towards each other but additionally the kicking player is swinging the kicking leg as fast as he can to impart kicking distance to a ball. It will thus be appreciated that the magnitude of force involved can vary greatly depending upon the particular circumstances of the situation from a slight tap to very great impact force sufficient to break a leg or arm bone etc.

For a large number of years it has been a substantially standard practice to use as protection for player's shin bone an elongate pad including a plurality of side by side reinforcement strips. The strips are enclosed within outer layers of padding intended to soften or otherwise reduce the impact force created by an impacting boot. In practice, these known forces of constructions have not proved to be reliably successful in warding-off impacts.

Also, historically, it has been almost universal practice for players to insert the known pads into their socks in such position as to be located in front of the shin bone to shield an area extending roughly from just below the knee down to the top of the foot arch of the user.

In practice, it has been found that this simple method of relying upon a sock to hold the shin guard in place has not been a sufficiently reliable method since the shin guard retention relied wholly upon the resiliency of the sock in withstanding the additional stretch arising from the presence of the movable shin guard. Thus, in cases where the socks were a little too large or had lost some of their initial elasiticity the shin guard retention capability was correspondingly reduced with the result that the shin guards were not held in their optimum positions within a sock throughout a game and/or were allowing the shin guards to fall from the socks.

With a view to combating this undesirable overall situation the practice has developed in relation to games like football, for the players tightl to strap or tie the shin guards in place.

As will be appreciated this need to strip or otherwise tie the shin guards in place, whilst providing a solution to the problem of the shin guards not remaining in the required position is not in itself a particularly desirable way of achieving the aim of retaining the shin guard in place for a variety of reasons including, for example, the problem of tying the ties/cords involved sufficiently tight enough to keep the shin guards in place without interfering with free blood circulation, without compressing muscles which during the course of a game are continuously being flexed and unflexed etc., to an extent that the ties or cords dig into the muscles when flexed possibly leading to the occurance of cramp in the legs.

A further serious problem in relation to the known pads is that, in practice, they have not afforded a great deal of protection in withstanding the full impact of a kick which has, to the misfortune of the person being kicked, of not being able to absorb sufficient of the impact forces to reduce them to a level at which the leg, and in particular the tibia, could withstand the residual forces and not badly bruise or break as a result of the impact.

As a consequence when a player has been using a conventional shin protecting pad there has remained an extremely high risk of tibia breakage and if not actual breakage several bruising and crush damage to the tibia with the possibility of the same general area receiving several damaging blows within a space of a few games of i.e., football, so that conditions are initiated for permanent weakness being induced into the leg structure.

OBJECTS OF THE INVENTION

It is an object of the present invention to provide a body part guard construction which provides enhanced resistance to impact.

It is a further object of the invention to provide arrangements for facilitating the wearing of protective body part guards so that they are maintained for as long as required in their optimum positions of use and in such manner as to avoid the introductions of problems such as suggested above.

STATEMENTS OF THE INVENTION

Broadly, according to the invention there is provided a body part protective guard incorporating an extended area member generally shaped to the form of the body part area to be protected and which is intended to overlie the body part to be protected, characterised in that the guard includes an extended area member of a force resistant resiliently deformable material the member being padded with impact absorbing material which when in use is interposed between the member and the body part.

Preferably, the extended area member includes a first part providing a primary impact force receiving area and two second parts integrally connected with the first part and extending outwardly away from opposite edge regions of the first part, and in that the second parts are connected in force transfer relationship with the first part.

Conveniently, the connection bwtween the first and second parts is such that that the first part is so connected to the second parts that on an impact occuring on the first part relative resiliently resisted distortion displacement is possible between the first and the second parts which displacement assists in the absorption of and transfer of impact force from the first to the second parts thereby to prevent the full impact force from being restricted only to the first part.

Preferably, each interconnection region between the first and a said second part effectively forms a stiffened rib like region which when the body part protective guard is in use extends in a direction generally along the direction of a bone structure of a body part bone structure specifically to be protected, and wherein the interconnection regions between the first and second parts are such as to facilitate the transfer of impact force from the first part to the second parts and to accommodate positional adjustment of the guard as a result of an impact force.

According to a further aspect of the invention there is provided a method of retaining a protective guard in place in relation to a part of the body it is desired to protect from impact force including the steps of fitting to the body part a sleeve formed of such material, size and form as to fit sufficiently firmly/snugly about body part as to remain in situ throughout use thereof, inserting a protective impact force accommodating guard into a pocket, pouch or the like provided in/on the sleeve, and so fitting the sleeve to the body part that the guard is located at such position as to be adjacent the region of the body part most likely to be subject to an impact force.

A further aspect of the invention provides means for retaining a protective guard in place in relation to a part of the body it is desired to protect from impact force, said means including a sleeve or the like of such material, size and form as to be able to fit firmly/snugly about the part of the body it is desired to protect so as to be able to remain in situ throughout use of said part, and means forming a pocket, pouch or the like provided in/on or otherwise associatable with the sleeve and adapted to receive a protective impact force accommodating guard, the arrangement being such that by suitable positioning of the the sleeve on the body part to be protected the guard can be located in the vicinity of the body part region most likely to be subjected to impact producing force.

If desired, the pocket can be of independent construction and releasably attachable to the sleeve by attachment arrangements such as hook and loop interconnection systems.

Conveniently, the force accommodating member comprises a composite structure incorporating a layer of relatively stiff non-compressible material that is to form the outer layer of the member, and a backing layer of a compressible material that forms the padding.

Preferably, the outer layer comprises a plastics material such as a polypropolene, whilst the backing layer comprises a plastics foamed material.

BRIEF DESCRIPTION OF THE DRAWINGS

For a better understanding of the invention and to show how to carry the same into effect reference will now be made to the accompanying drawings in which.

DESCRIPTIONS OF THE PREFERRED EMBODIMENTS

Figure 1:
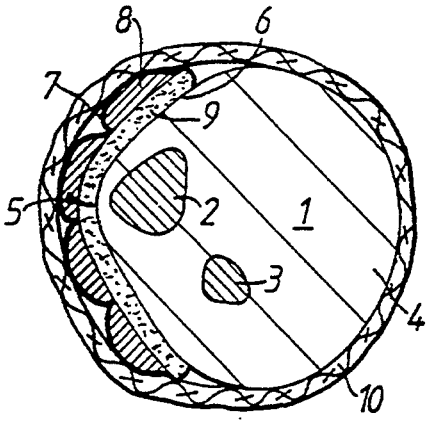
FIG. 1 very schematically illustrates in cross section a known form of shim protective guard positioned for protecting the lower part of a human leg.
Figure 2:
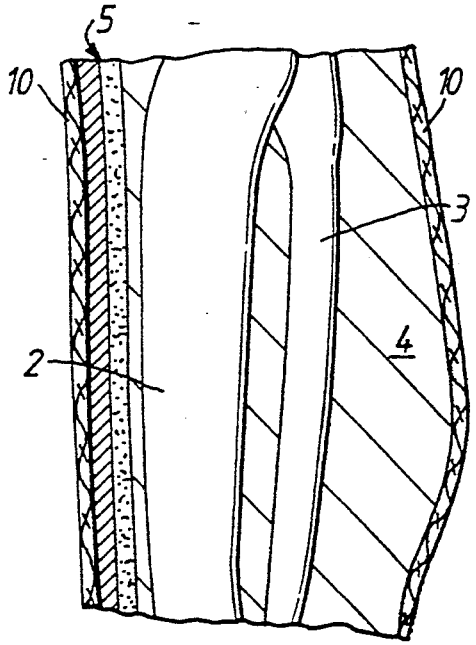
FIG. 2 very schematically illustrates in side view cross section the known guard cooperating with the human lower leg.

Referring to the drawings and more particularly to FIG. 1 this Figure very schematically illustrates a cross section of the lower part 1 of a human leg. In the Figure the tibia and fibula have been very schematically represented at 2 and 3 and the surrounding tissue at 4.

A known form shin pad is indicated at 5, comprising inner and outer layers 6 and 7 of material enclosing strips 8 of a stiffening material, the inner layer 7 being backed by a layer 9 of padding. The shin pad 5 is so formed that a quilted formation is produced so that the pad can readily deform to fold around the front and sides of the leg.

Each strip 8 of stiffening maerial serves to give the pad 5 stiffness along its lengthwise direction and thus when in use lengthwise of the leg. When in use the protection pad is held in place either by the user's sock 10 or is tied in place with tapes (not shown).

With these known constructions each strip 8 is effectively isolated from the adjacent strips 8 in the sense that when force is applied to any strip for example, (i.e., by a kick) to the strip(s) immediately in frown of the tibia 2 all of the force is dissipated into the elongate strip(s) 8 actually contacted by the kicking boot and thus into the leg itself. Whilst the padding of the contacted strips absorbs some of the energy generated by the kick most of the force involved is transmitted through the protective part directly onto the tibia. As is well known the front of the tibia 2 lies very close the skin surface and, in addition, exhibits a longitudinal ridge-like formation which means in terms of force applied thereto by a kick that the force involved is concentrated into a relatively small impact area so that any impact forces upon the tibia front area concentrated over a relatively small region/area. In fact, the effect of the impact having regard to the shape of a football boot being concentrated over such a small area is that the resulting impact per square centimeter is extremely large as compared with the forces arising when the same force kick impacts over a more extended area of the bone region.

Figure 3:
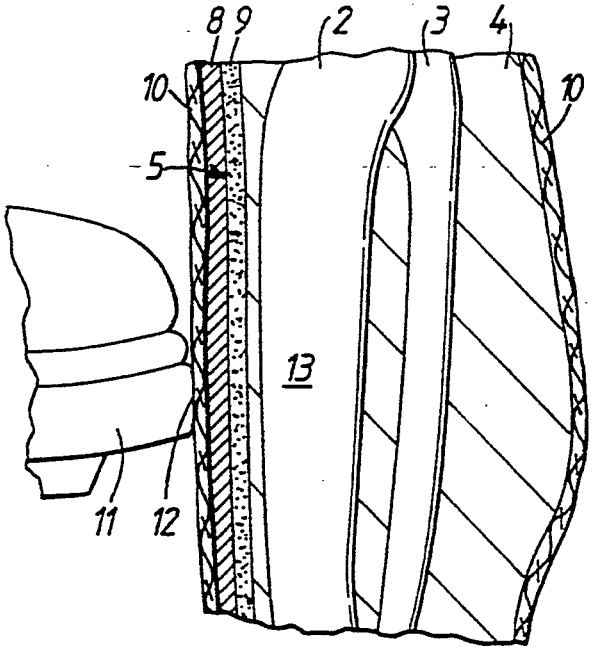
FIGS. 3, 4 and 5, very schematically shows successive stages of the effects of a boot impacting upon the known guard.
Figure 4:
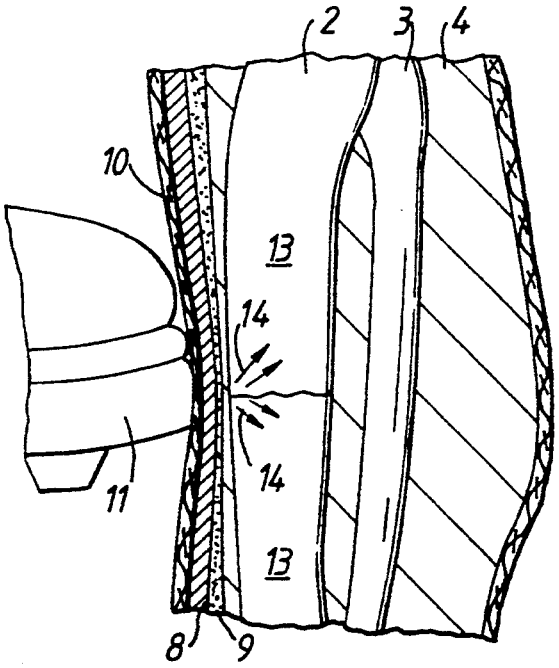
Figure 5:
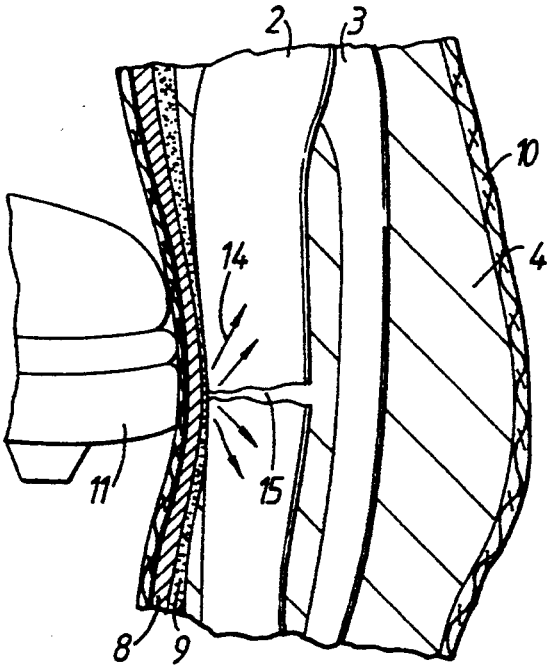
Figure 6:
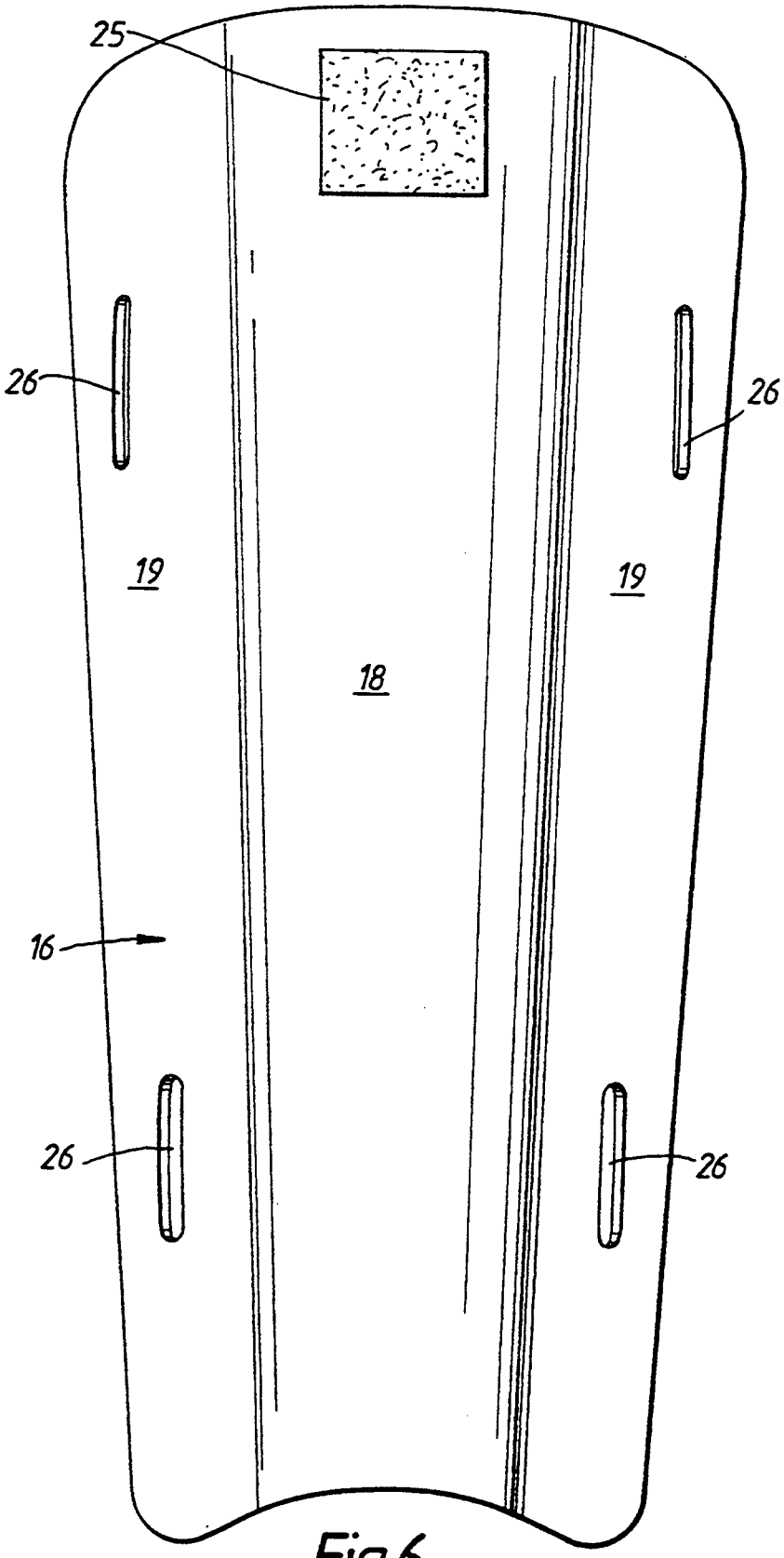
FIG. 6 is a front view of a body protection guard involving concepts of the invention.

The effect is very schematically demonstrated in FIGS. 3 to 5. In FIG. 3 a kicking boot 11 is illustrated at the instant of impact. As will be noted the area 12 of impact is very limited and having regard to the tibia cross section the tibia area immediately in front of the kicking boot 11 is effectively a relatively narrow vertical strip.

As the effects of impact commence to evolve the boot 11 continues to move forwards and as it is likely that the foot (not shown) of the kicked leg is at the time of impact on the ground i.e., positionally fixed at the instant of impact and the upper part of the leg may well be moving relatively rapidly towards the oncoming boot the relative velocity of impact and thus the potential energy involved is enhanced with corresponding increase in the force imparted to the known pad/tibia combination.

Since the known pads 5 are not able to dissipate forces from the impacted protective strips 8 to adjacent padded strips 8 the impact full force remains undiverted and is, as has been mentioned, only marginally dissipated by the collapsing of the padding 9 so that the forces involved are effectively directly imparted to the tibia as shown is schematically represented by the arrows 14 in FIG. 4.

If the impact force exceeds the ability of the tibia to accommodate the force the tibia breaks as is indicated at 15 in FIG. 5.

Figure 7:
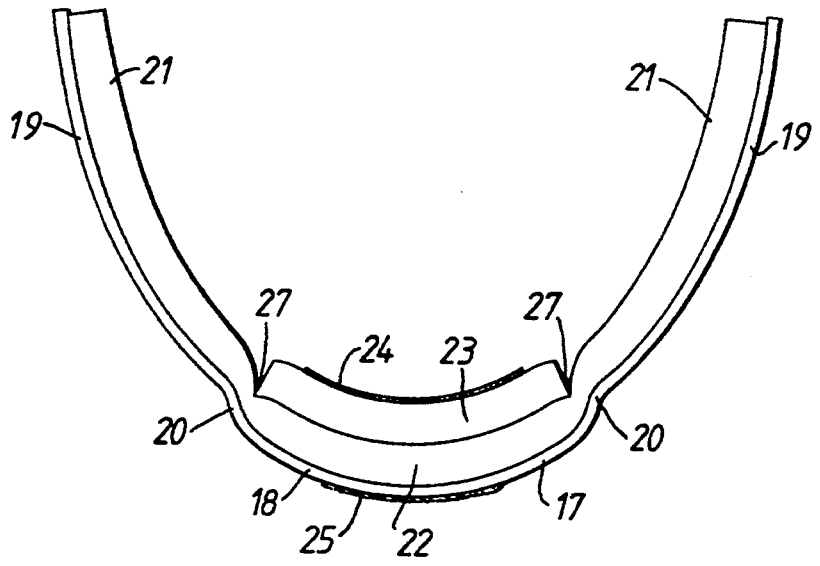
FIG. 7 illustrates in an end view in the direction A of a body part protection guard as illustrated in FIG. 6.
Figure 8:
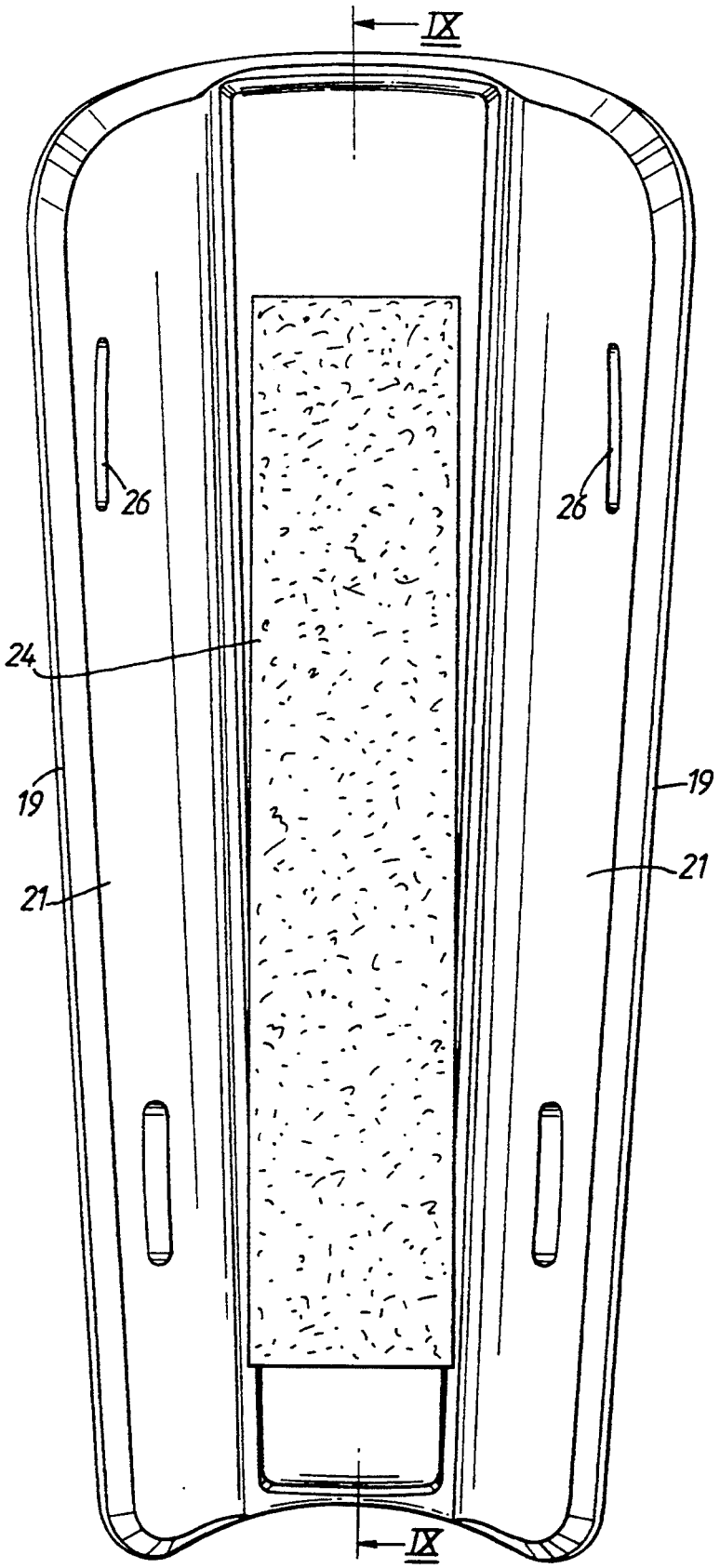
FIG. 8 is a rear view of a body protection guard of FIG. 6.
Figure 9:
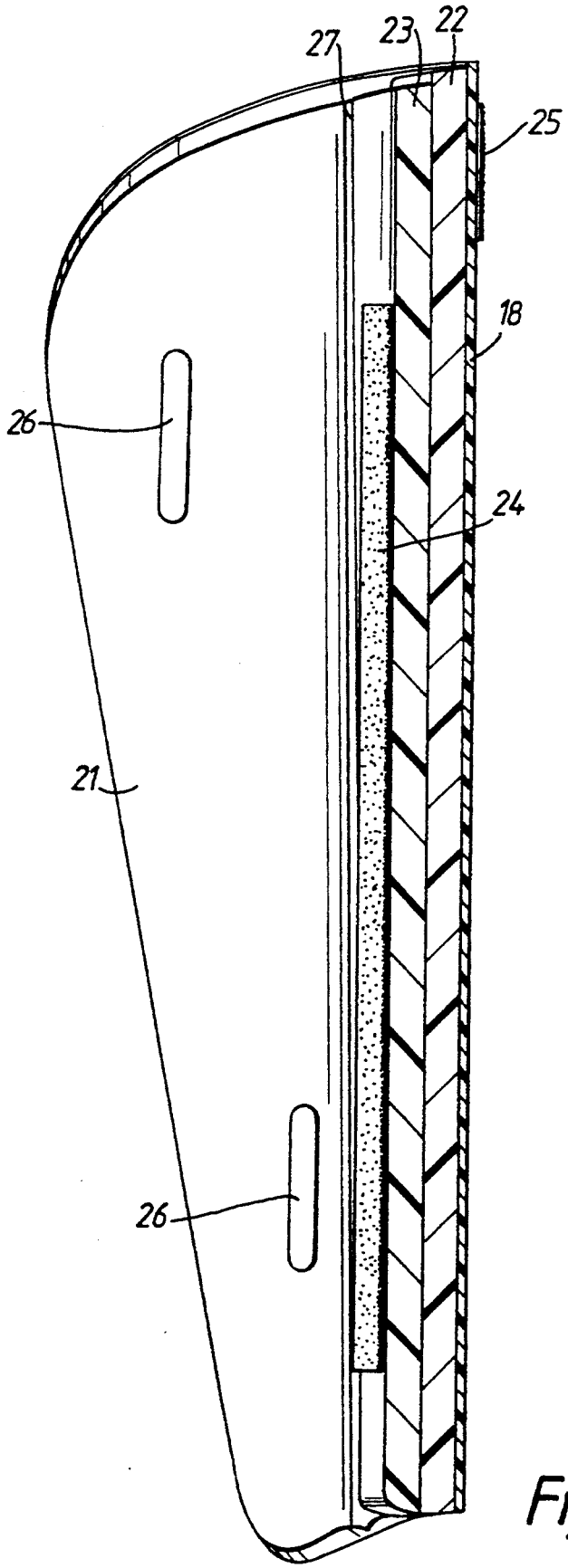
FIG. 9 is a lengthwise medial section of the protection guard of FIGS. 6 to 8.

Referring now to FIGS. 6 to 9 these illustrate a body part protection guard 16 in accordance with the concepts of the invention. The guard 16 includes an outer resilient member 17 formed by a layer of relatively stiff not easily compressible material. The member 17 is so profiled, as shown in FIG. 7, as to define a central strip part 18 and two side parts 19, with the outer surface of the central strip 18 effectively raised with respect to the immediately adjacent regions of the side parts 19.

This stepped formation provides the outer member 17 with additional lengthwise stiffness and can conveniently be regarded as having two lengthwise directed ribs, or steps 20 such that the central strip 18 stands slightly proud of the adjacent side parts 19.

This outer member 17 is backed by padding formed by compressible impact force dissipating layers. As will be noted in the embodiment shown the side parts 19 are provided with single thickness layers 21 and the central strip part 18 is backed by a double thickness of the impact force dissipating material by incorporating two layers 22 and 23.

Preferably, the outer member 17 comprises a plastics material such as a polypropolene, whilst the padding material comprises compressible material layers 21,22,23 formed from, for example, plastics foamed material such as extruded polystyrene having, for example, a density of 0.9 grms per cubic centimeter and an impact resistance of 24 Kilograms per cubic Meter.

In practice, the detailed shape and profile/formation of the guard will be governed by the particular nature of the region to be protected.

An inner layer of padding material 24 extends lengthwise of the inner padding layer 23 for almost the full length thereof. For reasons to be considered hereinafter, an patch/area 25 of the material connection system involving interengageable hooks and loops is coupled to outer member 17 adjacent to the upper end of the outer member 17. The lower end of the guard is shaped so as to conform to the general shape of the upper part of the user's foot adjacent to the ankle region.

For users who wish to tie the guard 16 in place the side parts 19 are provided with tape receiving slots 26. The use of relatively wide slots enables use of corresponding wide tapes and assists in avoiding the gathering of the tapes into narrow strings.

It will be noted that the adjacent edge regions of the padding layers 21,22 are shaped as shown at 28 to facilitate the flexure of the central part 18 relative to the side parts 19.

The overall transverse profile of the guard 16, as may be noted from FIG. 7 is such that the central strip 18 is, when the guard is in use, located essentially immediately in front of the tibia whilst the side parts 19 are so set with respect to the central part that they engage with the sides of the user's leg. The overall dimensions are such that the side parts 19 press gently against the user's legs so that the do not unnecessarilyy project outwardly of the legs to create a possible hazard condition.

With a view to facilitating the correct positioning of the guard 16 with respect to the body part to be protected it is intended that the guard 16 be engaged in a pocket provided upon a sleeve that is intended snugly to fit over the body part i.e., limb to be protected.

Figure 10:
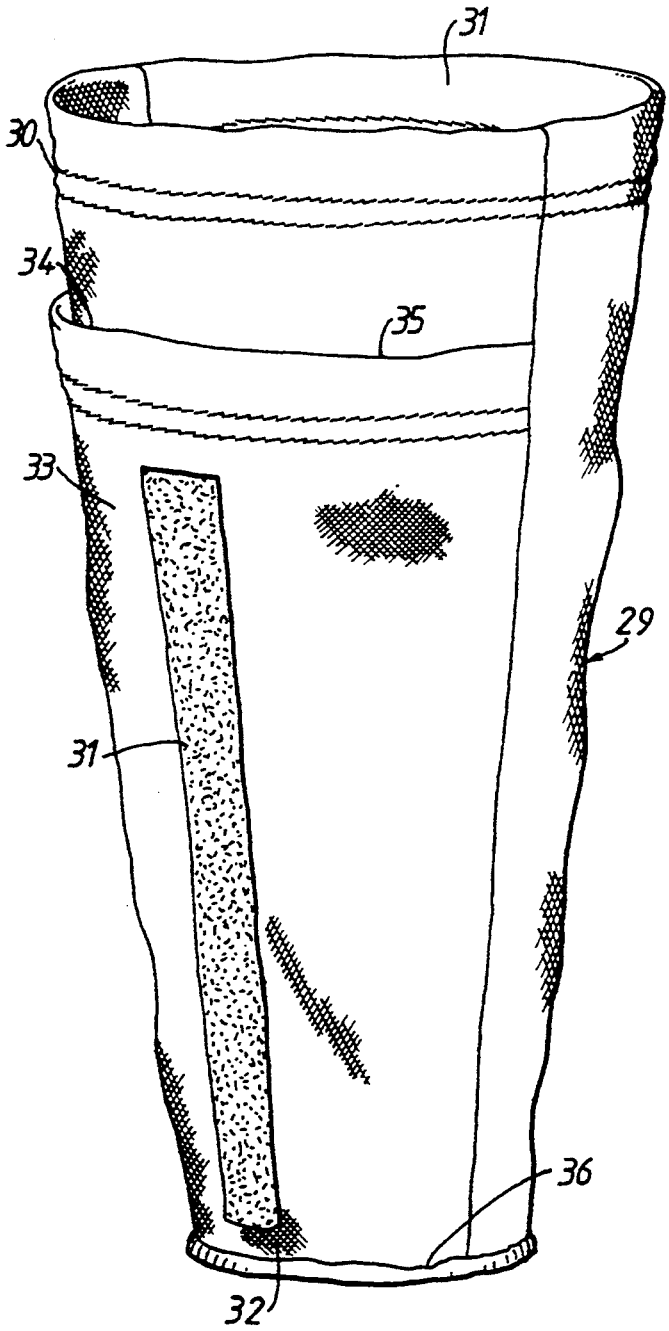
FIG. 10 very schematically illustrates in perspective view a mounting sleeve/sock for locating the protection guard of FIGS. 6 to 9 for the purposes of use.
Figure 11:
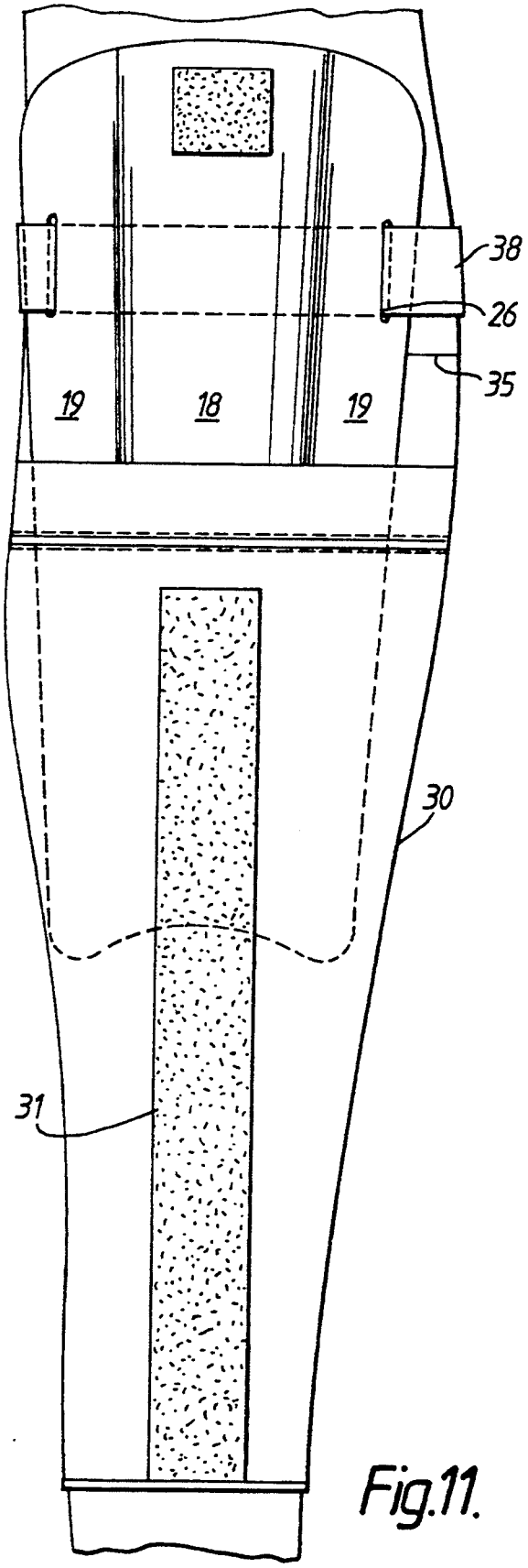
FIG. 11 is a front view illustrating the sleeve/sock on a user's leg and having partially inserted therein a body part guard incorporating the concepts of the invention and as shown in previous Figures.

Referring now to FIGS. 10 and 11 of the drawings the mounting arrangement for the guard 16 includes a main sleeve 30 which is intended to be engaged with the body part to be protected i.e., lower leg, the sleeve 30 being formed from an elasticated type of material which preferably allows for a close fit plus stretchability in directions transverse to each other.

The sleeve 30 can be produced by suitable folding and stitching of a blank of shaped material to provide joining seam or seams, and suitable hems at the ends of the sleeve. Alternatively, the sleeve 30 can be produced initially in tubular form by any convenient process i.e., circular knitting, weaving etc.

The sleeve 30 in the embodiment shown is open at both its upper and lower ends 31 and 32. Since it is intended that the sleeve 30 should fit snugly over the lower leg of the user the sleeve slightly tapers from a wider upper end 31 to a narrower lower end 32.

As this narrower end 32 is intended when in use to be located close to the upper regions of the user's foot the narrower end can, if desired, be inwardly curved so as to allow a neater and closer fit.

A pane 33 of the elasticated material is secured to the sleeve 30 in such manner as to form a pocket 34 open at its upper end 35 and closed at its bottom end 36.

The pocket 34 is of a convenient size as to be able to accommodate a protective guard 16 as discussed hereinbefore.

A vertical material strip 37 formed by part of a hook part of the well known fabric hooks and loops fabric connection system is coupled to the front of the pocket in a conventional manner. This strip inter alia assists in holding-up a conventional sock which would be worn outside of the sleeve.

Thus a further aspect of the invention is the combination of the sleeve/sock in conjunction with the guard 16.

FIG. 11 illustrates a guard 16 when partially housed in a pocket 34 of the sleeve 30 the latter being illustrated fitted to the lower leg. When fully inserted the area 25 will hook onto the material of the pocket and thus assist in retaining the guard 16 within the pocket 34.

For the purposes of illustrating the function of the slots 26 a tape 38 is shown threading the slots and passing around the user's leg.

Figure 12:
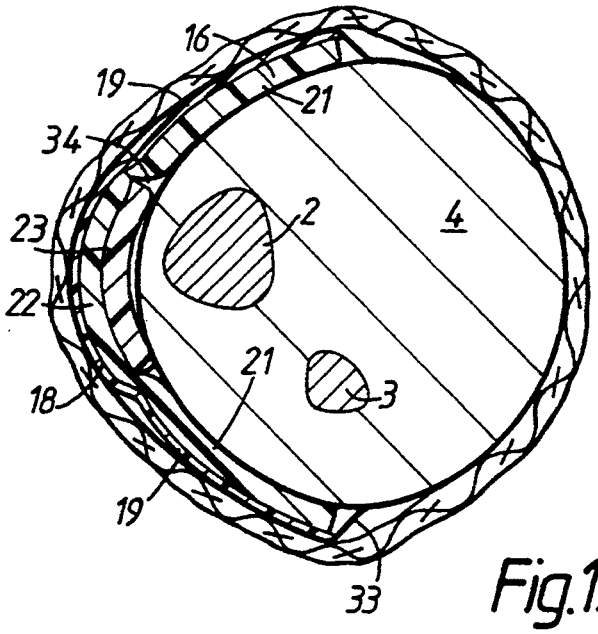
FIGS. 12 and 13 are respectively transverse and longitudinally cross sections very schematically illustrating in side view cross section the guard of FIGS. 6 to 9, cooperating with the human lower leg.
Figure 13:
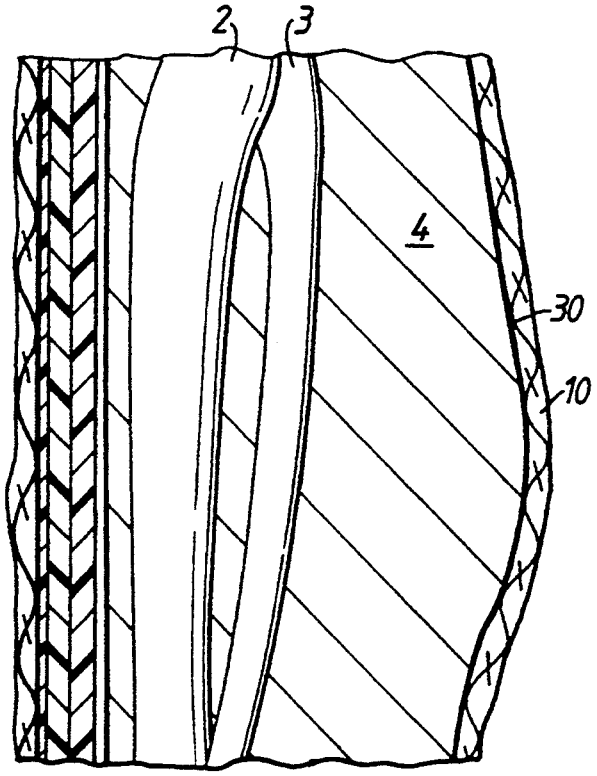

Referring now to FIGS. 12 and 13 these illustrate in transverse and longitudinal cross-section respectively a guard 16 located in a pocket 34 of a sleeve 30 worn on the user's leg 1. It will be noted that the side parts 19 fit snugly against the sides of the leg.

The overall shaping of the member 17 is such that when the guard is fitted a narrow space is effectively formed between the leg and the rear face of the inner padding layer 23. It should be noted that even in situations where such a space is not left the padding is not in an initially compressed space so that when impact forces are exerted upon the guard the initial effect is for the forces to be transferred outwardly from the region of impact on the central strip 18 into the side strips by way of the stepped regions 20. This transfer of force effectively increases the effective area over which the force is applied and in so doing decreases the pressure at the central strip and thus directly towards the tibia. This force distribution thus at least initially tends to move the guard 16 towards the user's leg thereby compressing the padding 21,22, 23 overall against both the front and sides of the leg so that a much greater area of the leg is subjected to the inpact force leading to a corresponding reduction in the magnitude of the force directed towards the tibia.

Figure 14:
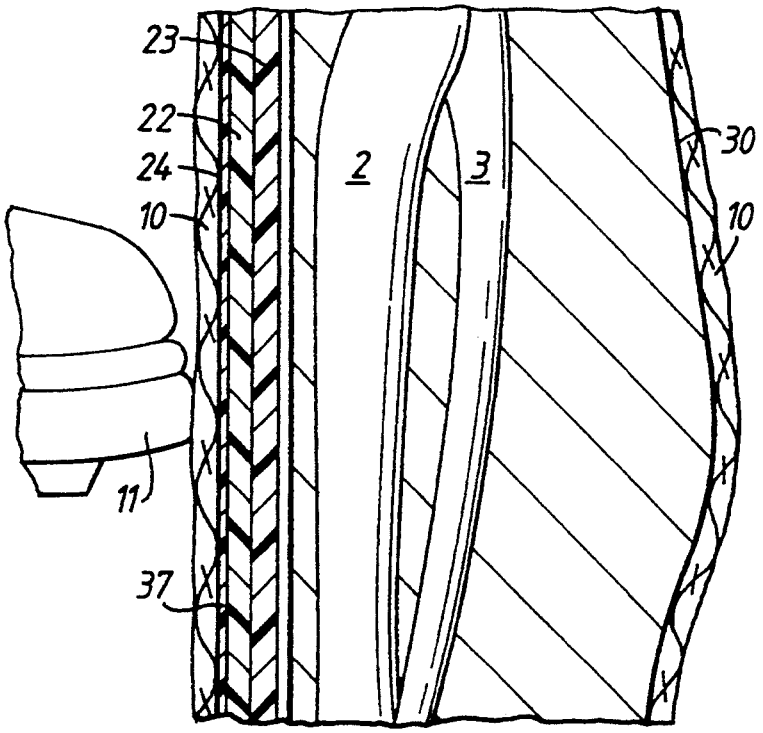
FIGS. 14 and 15, illustrate in transverse longitudinal cross section successive stages of a boot impacting upon a limb having associated therewith a guard as shown in FIGS. 6 to 9.
Figure 15:
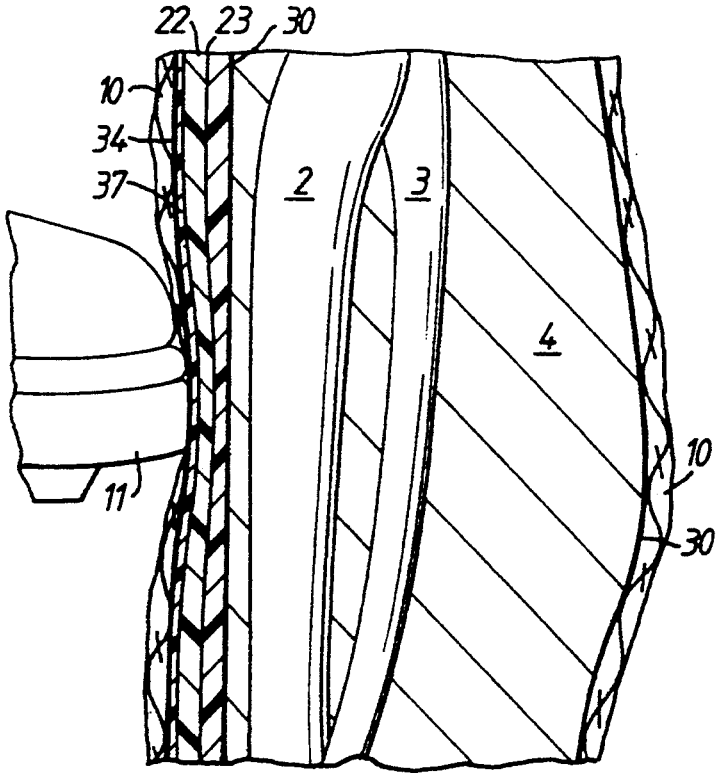

In addition, as may be particularly noted from FIGS. 14 and 15 the provision of the double thickness padding layers 22 and 23 ensures that by the time the impacting boot has full compressed the padding the remaining energyy of the kick starts to exert direct pressure against the leg of the guard user. However, by the time the padding has been fully compressed the energy of the kick has usually been significantly reduced in magnitude to such extent that, in the event that the guard is pushed hard against the user's leg the residual energy in the kick is not likely to be sufficient to break the tibia.

The conditions prevailing during such compression are shown in FIG. 15.

Whilst the drawings have illustrated the use of a leg bone protector guard it will be appreciated that the concepts of the invention could be applied to other parts of the body.

For instance, the sleeve, pocket and member assembly can be dimensioned and shaped with a view to the protection of for example, the user's forarm, upper arm and/or thigh regions.

Also the concepts of the invention can be applied to the provision of guards for the ankles to give protection to impacts upon the ankle bones of the user without impeding the flexibility of ankle usage. For this purpose, the sleeve part would be shaped to provide a formation somewhat similar to the formation of the heel region of a sock or the like. In this case, if thought convenient the pockets for receiving the requisitely shaped guard shields can be provided to afford protection from kicks, blows etc. to the ankle bone.

From the forgoing it will be understood that the guard includes an extended area member of a force resistant resiliently deformable material the member being padded with impact absorbing material which when in use is interposed between the member and the body part. In other words the outer member of the guard needs to be strong enough and sufficiently flexible so to be able to deform to accommodate the effects of impact force and not to shatter crack or otherwise be damaged as a result of the application of an impact force.

That is to say the guard needs to have a combination of stiffness and inherent springiness to be able distort under impact force and to rerurn to its initial form after dissipation of such force.

With the construction particularly shown in the Figures the requirement is that the connection between the first and second parts is such that that the first part is so connected to the second parts that on an impact occuring on the first part relative resiliently resisted distortion displacement is possible between the first and the second parts which displacement assists in the absorption of and transfer of impact force from the first to the second parts thereby to prevent the full impact force from being restricted only to the first part.

To facilitate this, as has been mentioned above, each interconnection region between the first part and a said second part effectively forms a stiffened region which when the body part protective guard is in use extends in a direction generally along the direction of a bone structure of a body part to be protected so that the stiffened interconnection regions between the first and second parts are such as to facilitate the transfer of impact force from the first part to the second parts and also to accommodate relative distortional displacement of the first and second parts arising from application of said impact force.

In a modified construction the pockets 34 can be formed separately from the sleeves 30 and can be releasably attachable thereto by hook and loop attachment means not requiring any solid or rigid components.

It will be understood that whilst the above discussion has mentioned the use of a single guard it will be appreciated that by providing more than one pocket to a sleeve construction or the like two or more guards can be simultaneously provided for a particular body part.

Thus for example, a forearm guard can be provided at least two pockets to give protection to the different areas of the forearm.

It is claimed:

1. A body part protective guard assembly generally shaped to the form of the body part area to be protected and which is intended to overlie the body part to be protected comprising:

an outer guard layer formed from a force resistant resiliently deformable material, the outer layer being padded with an impact absorbing material backing layer which when in use is interposed between the outer layer and the body part;

the outer layer comprising a single sheet of relatively stiff resiliently deformable non-compressible material effectively divided into a central part and two side parts extending outwardly away from opposite edge regions of the central part and connected to said central part by elongated profiled regions which are arranged to define regions of resilient flexure between the central and side parts to facilitate relative flexure therebetween whereby on an impact occurring on the central part relative resiliently resisted distortion displacement is possible between the central and the side parts by way of the profiled regions in such manner that the displacement assists in the absorption of and the transfer of impact force from the central to the side parts thereby to prevent the full impact force from being restricted only to the central part and thus to the impact absorbing material immediately associated therewith;

a cylindrical sleeve generally shaped to the form of the body part area to be protected and formed with a pocket;

said sleeve and pocket being formed from a flexible woven type cloth material;

said outer guard layer and impact absorbing material located within said pocket; and wherein said sleeve is freely positionable along said body part to locate its pocket and guard layer at an area of the body to be protected so that the force of any blows to the body part at said area will be taken upon only by the guard and the flexure of its side parts and distributed to the body part through the impact absorbing material.

2. The body part protective guard as claimed in claim 1, and characterised in that the profiled regions comprise steps.

3. The body part protective guard as claimed in claim 1, and characterised in that the outer layer comprises polypropylene in sheet form and the backing layer extruded foamed polystyrene.

4. The body protective guard of claim 1 wherein the impact absorbing material backing layer underlies the central part and portions of the two side parts.

5. The body protective guard of claim 4 wherein there is a second backing layer that underlies the backing layer that underlies the central part.

* * * * *